United States Patent [19]

Bozzo

[11] Patent Number: 5,063,985

[45] Date of Patent: Nov. 12, 1991

[54] METHOD AND APPARATUS FOR THE INSTALLATION OF SECTOR-SHAPED CURTAINS ON CORRESPONDINGLY SECTOR-SHAPED WINDOWS

[76] Inventor: Romolo T. Bozzo, 775 King Street East, Hamilton, Ontario, L8N 1A7, Canada

[21] Appl. No.: 538,614

[22] Filed: Jun. 15, 1990

[51] Int. Cl.[5] ..... A47H 1/00

[52] U.S. Cl. ..... 160/330; 160/134

[58] Field of Search ..... 160/330, 134, 84.1, 160/38, 387; 411/457

[56] References Cited

U.S. PATENT DOCUMENTS

| | | | |
|---|---|---|---|
| 2,349,547 | 5/1944 | Gisondi | 411/457 X |
| 3,733,227 | 5/1973 | Collins | 160/330 X |
| 4,825,611 | 5/1989 | Bassett | 160/372 X |

FOREIGN PATENT DOCUMENTS

| | | | |
|---|---|---|---|
| 1577827 | 8/1969 | France | 160/330 |
| 1162201 | 8/1969 | United Kingdom | 160/330 |

*Primary Examiner*—Blair M. Johnson
*Attorney, Agent, or Firm*—Rogers & Scott

[57] ABSTRACT

A new method and apparatus for the installation of sector-shaped curtains on correspondingly shaped windows requires the provision of a piece of curtain material of suitable length and width; sheer tape is attached to the top edge and the piece is gathered using the tape to the length of the curved circumferential portion of the window. One part of a two part hook-and-loop fastening is attached to the curved portion of the window while the other is sewn to the gathered curtain top edge and the curtain is then attached using thus fastening. A securing member having two protruding side-by-side impaling spikes is attached to the middle of the straight circumferential window casing portion and the curtain is then impaled while under tension on the two spikes, one half on each. The curtain is usually completed by impaling a decorative finial on a third spike disposed between the two on which the curtain is impaled so as to cover the bunched curtain material at this point.

21 Claims, 2 Drawing Sheets

METHOD AND APPARATUS FOR THE INSTALLATION OF SECTOR-SHAPED CURTAINS ON CORRESPONDINGLY SECTOR-SHAPED WINDOWS

FIELD OF THE INVENTION

This invention is concerned with a new method and apparatus for the installation of sector-shaped curtains on correspondingly sector-shaped windows, particularly but not exclusively such windows of semi-circular shape.

REVIEW OF THE PRIOR ART

It is usual to cover a window with some form of curtain material, usually consisting of a strip of fabric that is gathered along its top horizontal edge to be about 35–50% of its original length and then suspended to hang in front of the window. Windows have in the past been used which in the vertical plane are of sector-shape, usually either semi-circular or semi-elliptical, and recently such windows have become very popular. However, the provision of a satisfactory curtain for such a window has been an extremely difficult task, requiring the services of a highly skilled decorator, and being always time-consuming, so that its execution is correspondingly difficult and expensive, to the extent that many such windows are left uncurtained.

DEFINITION OF THE INVENTION

It is the principal object of the present invention to provide a new method for the installation of sector shaped curtains on correspondingly sector-shaped windows.

It is another object to provide new apparatus, comprising a securing device, and a kit including such a securing device, for the installation of sector shaped curtains on correspondingly sector-shaped windows.

In accordance with the present invention there is provided a method for the installation of a sector shaped curtain on a sector-shaped window having a curved perimeter portion and a straight chordal perimeter portion between the ends of the curved perimeter portion, the method comprising the steps of:

attaching to the window curved perimeter portion a length of one part of a two-part fastening material so as to extend from one end of the portion to the other;

providing a length of flexible curtain material;

gathering the flexible curtain material along one edge thereof until its gathered length is equal to that of the window curved perimeter portion;

attaching to the gathered curtain edge along its entire length a length of the other part of the two-part fastening material;

attaching the one part of the fastening material to the other part to attach the gathered curtain material to the window curved perimeter portion so as to extend from one end thereof to the other;

tensioning the gathered curtain material perpendicularly to the gathered edge and while so tensioned gathering its free edge and impaling it on an impaling member of a securing member disposed at least approximately at the middle of the length of the straight chordal perimeter portion.

Preferably the securing member comprises two impaling members side-by-side, each member securing a respective half of the tensioned gathered curtain material. Preferably also the securing member comprises a finial impaling member adjacent the first-mentioned impaling member or members to receive a finial decoration at the centre of the straight chordal perimeter portion.

Also in accordance with the invention there is provided apparatus for the installation of sector-shaped curtains on correspondingly sector-shaped windows comprising:

a length of two part fastening material, one part of which is adapted to be fastened to the window casing curved perimeter portion and the other part of which is adapted to be fastened to the gathered edge of the flexible curtain material;

a length of sheer gathering tape adapted to be fastened to the edge of the curtain that is to be fastened to the window casing curved perimeter portion; and a securing member adapted to be fastened to the casing of the window straight chordal perimeter portion at about the centre thereof and having at least one impaling member protruding therefrom upon which the tensioned gathered curtain can be impaled to hold it under tension between itself and the respective other part of the two part fastening material.

Further in accordance with the invention there is provided a securing member for use in apparatus for the installation of sector-shaped curtains on correspondingly sector-shaped windows comprising:

a base member adapted to be fastened to the casing of the window chordal perimeter portion at about the centre thereof; and two transversely spaced impaling members which when the securing member is fastened to the window casing protrude side-by-side horizontally therefrom to receive respective halves of the tensioned gathered curtain.

Preferably the base member also has protruding therefrom a finial impaling member disposed between the two first-mentioned impaling members and adapted to receive a centrally disposed finial decorative member.

DESCRIPTION OF THE DRAWINGS

A particular preferred embodiment of the invention will now be described, by way of example, with reference to the accompanying diagrammatic drawings, wherein.

DESCRIPTION OF THE PREFERRED EMBODIMENT

The invention will be described as applied to a window of conventional type consisting of a lower portion 10 that in the vertical plane of the surrounding wall is rectangular in shape, surmounted by an upper portion 12 that in the same plane is semi-circular in shape. The invention is also applicable to windows of other shapes, such as semi-elliptical, that may be characterised as being of sector shape, consisting of a smoothly curved perimeter portion, usually the upper portion, joined together at its ends by a straight chordal portion, usually the lower portion and disposed horizontally. The glass of the window is mounted in a wood or metal casement, most usually of wood, consisting of a respective curved upper portion 14 and a straight lower portion 16.

Figure 1:
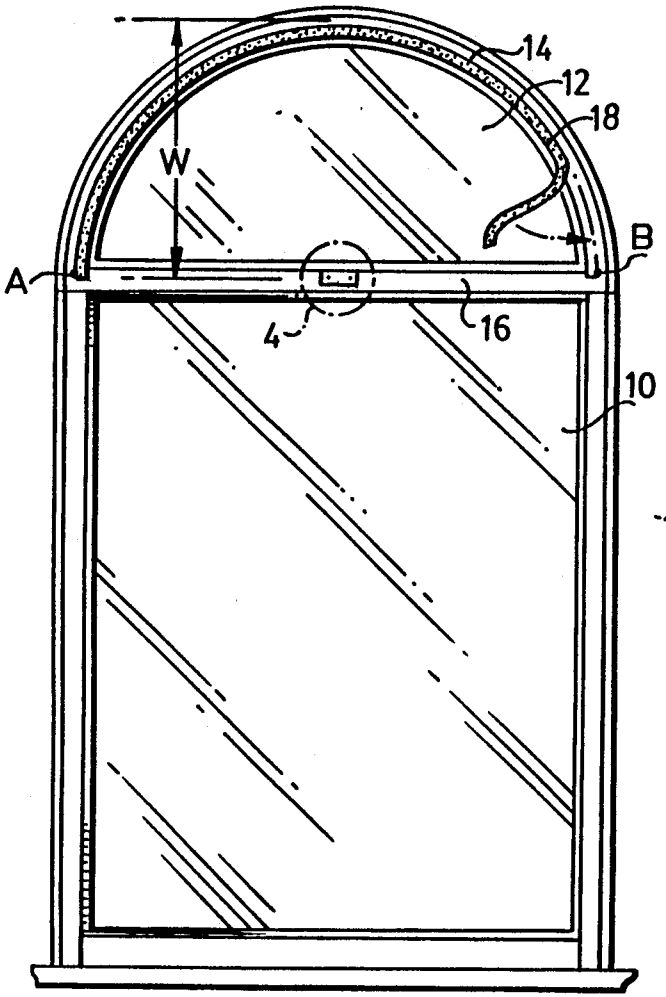
FIG. 1 is a front elevation of a typical window to which the invention is applied.

A first step is to measure the distance between points A and B (FIG. 1) around the curved casement portion 14, and to apply to this portion a corresponding length 18 of one part of a two-part hook-and-loop type fastening material, such as that sold under the trade mark "Velcro". The material is sufficiently flexible to follow the curvature and can be attached to the casement by stapling or glueing. A piece 20 of suitable curtain fabric is chosen, which as illustrated can be of rectangular shape, the length being determined by the distance A.B and the degree of gathering that is desired; for example if double weight is required the length will be 2(A.B). The width W of the piece is determined by the radius of the window 12 since in this embodiment it is semi-circular. If the window is semi-elliptical it will usually be installed with the major axis horizontal, and the width will then be just larger than half the distance from A to B measured along the straight casement portion 16.

Figure 2:
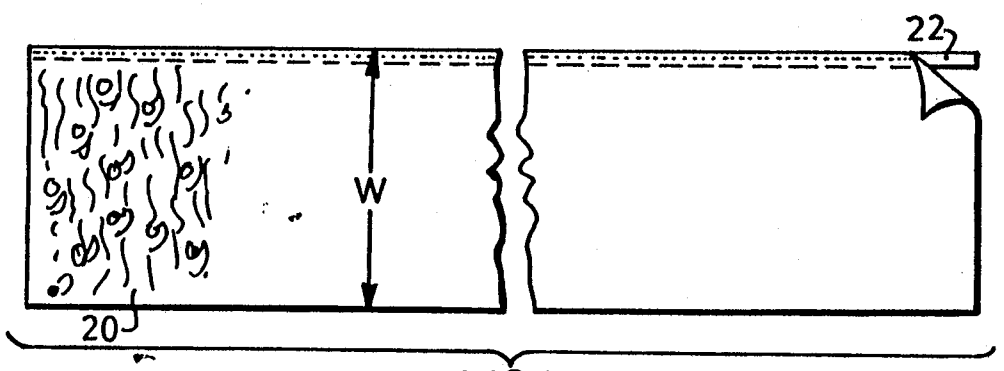
FIG. 2 is a front elevation of the window curtain material prior to being gathered.
Figure 3:
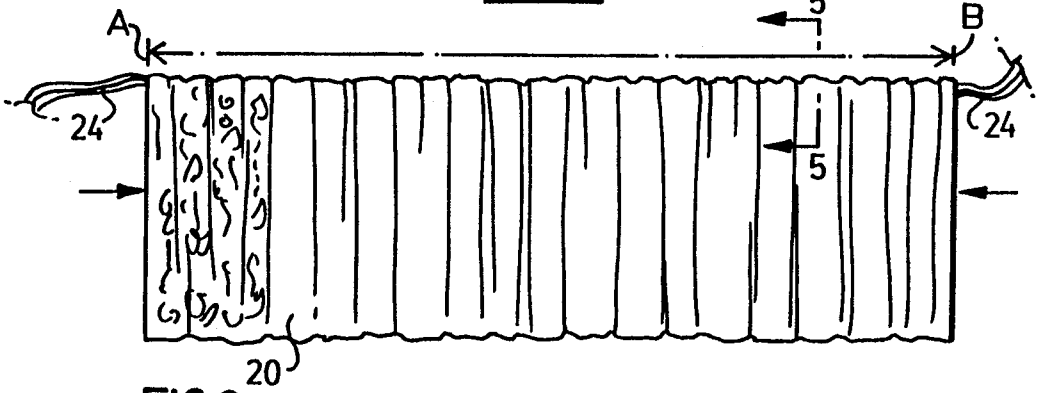
FIG. 3 is a similar front elevation of the window curtain material subsequent to being gathered.
Figure 6:
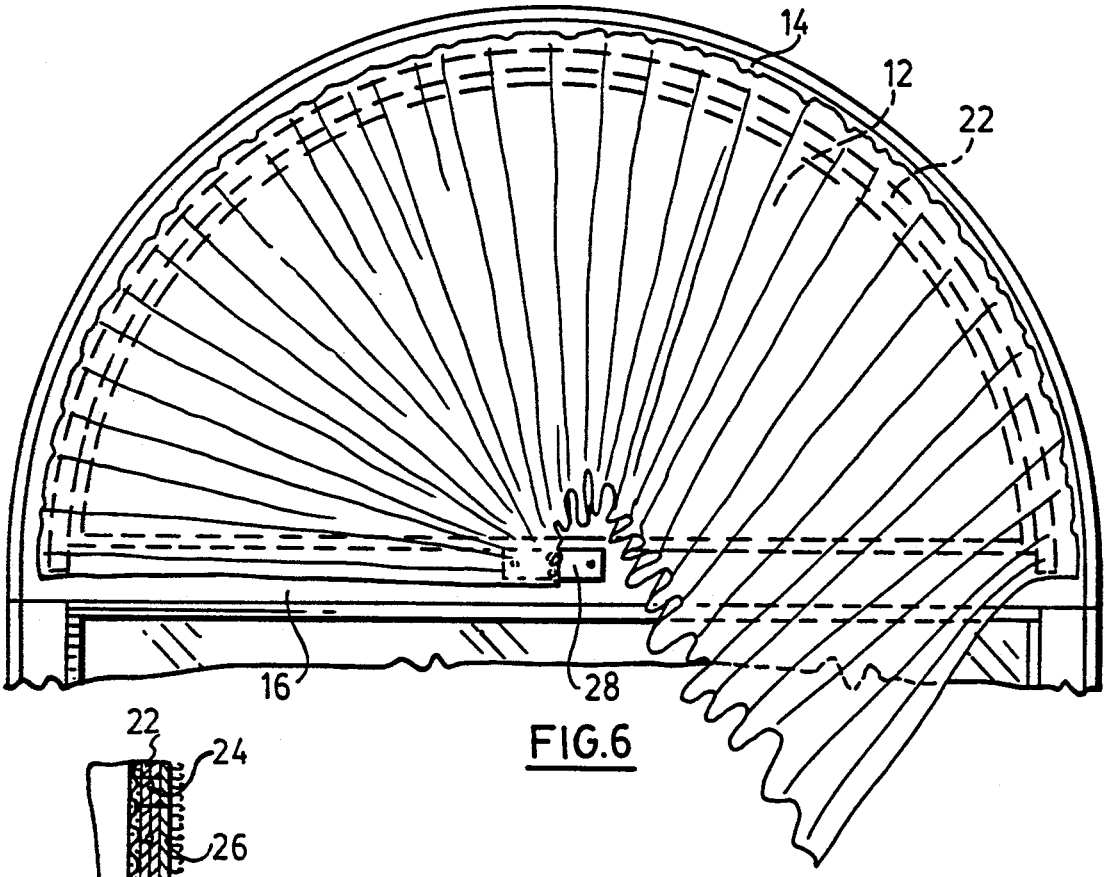
FIG. 6 is a front elevation of the window with the curtain partly installed.
Figure 5:
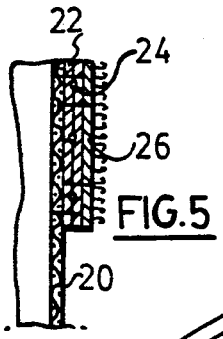
FIG. 5 is a cross-section on the line 5—5 of FIG. 3.
Figure 7:
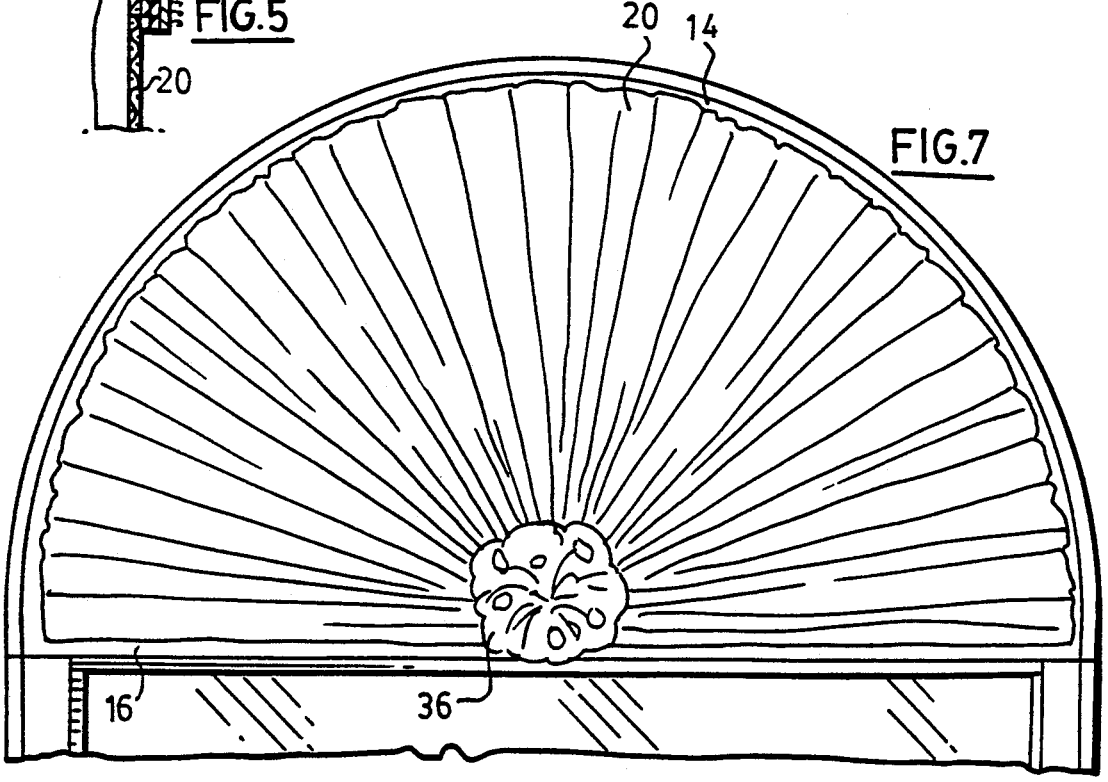
FIG. 7 is a view similar to FIG. 6 showing the window drapery fully installed together with a central finial decoration.

A length 22 of standard sheer tape is stitched to what will be upper edge of the piece 20, this tape having strings such as 24 passing sufficiently freely between two layers of fabric that the piece 20 can be gathered to the desired fullness in the usual manner by use of the tape, as illustrated by FIG. 3, the piece now being of length A.B; the ends of the strings are secured and the surplus portions are cut off. A piece 26 of length A.B of the other part of the two part hook-and-loop fastening material is now stitched over the sheer tape, as illustrated by FIG. 5, and the top edge of the gathered curtain is attached by this fastening material 18,26 to the curved casement portion 14, as illustrated by FIGS. 6 and 7.

Figure 4:
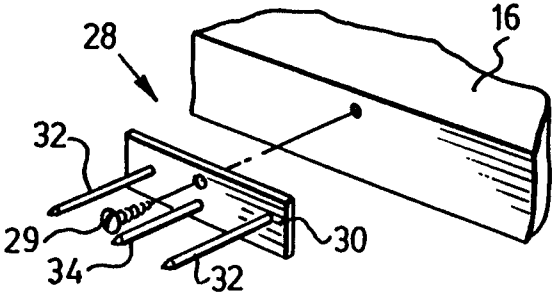
FIG. 4 is a perspective view to an enlarged scale of a securing device used in the invention.

An attachment device 28 shown in detail in FIG. 4 has previously been fastened, as by a wood screw 29 passing through the base member 30 thereof, to the straight casing portion 16 as closely as possible to its centre midway between the points A and B. This device is provided with two transversely spaced, parallel impaling members 32, consisting of respective elongated metal spikes extending horizontally side by side and perpendicular to the base member 30. A third shorter impaling member 34, shorter than the two spikes 32, extends parallel to those other spikes approximately midway between them. The installer now takes the hanging gathered end of the curtain and, starting either at point A or B, applies tension to the curtain material while at the same time impaling it on the respective nearest impaling member 32. As is illustrated by FIG. 6, each member receives a respective half of the tensioned gathered curtain material. Upon reaching half way from the point A or B impaling upon one spike the installer then starts at the other point and continues the installation, now impaling the material on the other spike, until the curtain is fully installed, as illustrated by FIG. 7. The curtain installation will usually be completed by impaling a pre-formed decorative finial member 36 such as a rosette on the central spike 34, also as illustrated by FIG. 7, in order to cover the central gathered portion and the securing member in a decorative manner.

In the case of a non-semi-circular window the bunch of gathered material at the attachment device will be somewhat irregular and difficult to hide with the finial device 36. In such case the curtain is installed as described and then removed; the lower edge portion will now be found to have a row of holes that are an accurate guide to the amount of the lower edge portion of the curtain that needs to be removed to correct this situation, the resultant cut edge usually being oversewn to prevent fraying or unravelling. It will also be seen that at any time the curtain can readily be removed for cleaning and thereafter reinstalled.

In a specific non-limiting example the piece of curtain material measured 225 cm by 67.5 cm (90 ins by 27 ins) and was gathered to double fullness to a length of 112.5 cm (45 ins) using sheer tape that was 2.5 cm (1 in) wide. The fastening material 18,26 was 1.9 cm (0.75 in) wide and the portion 18 was stapled to the casement. The securing member 28 had a base member 30 measuring 6 cm by 2 cm (2.4 in by 0.8 in) with the three spikes 32 and 34 all of length 7 cm (2.8 ins), and diameter 3 mm (0.12 in), the two spikes 32 being spaced 4 cm (1.6 in) apart with the third spike 34 disposed midway between the two spikes 32. A kit for use by a decorator in installing such a curtain will include the securing member together with a length of flexible material, such as string, to enable the distance AB to be measured on the window in question. Most interior decorator establishments will already have available the two-part fastening material and the sheer tape.

It will be understood that although a single specific embodiment has been described, the invention is applicable broadly to the installation of such curtains, within the scope of the appended claims.

I claim:

1. A method for the installation of a sector shaped curtain on a sector-shaped window having a casing with a curved perimeter portion and a straight chordal perimeter portion between the ends of the curved perimeter portion, the method comprising the steps of:

attaching to the window casing curved perimeter portion a length of one part of a two-part fastening material so as to extend from one end of the portion to the other;

providing a length of flexible curtain material;

gathering the flexible curtain material along one edge thereof until its gathered length is equal to that of the window curved perimeter portion;

attaching to the gathered curtain edge along its entire length a length of the other part of the two-part fastening material;

attaching the one part of the fastening material to the other part to attach the gathered curtain material to the window casing curved perimeter portion so as to extend from one end thereof to the other;

tensioning the gathered curtain material perpendicularly to the gathered edge and while so tensioned gathering its free edge and impaling it on an impaling member of a securing member disposed at least approximately at the middle of the length of the casing straight chordal perimeter portion.

2. A method as claimed in claim 1, wherein the securing member comprises two impaling members side-by-side, each member securing a respective half of the tensioned gathered curtain material.

3. A method as claimed in claim 1, wherein the securing member comprises a finial impaling member adjacent the first-mentioned impaling member to receive a finial decoration at the centre of the chordal perimeter portion.

4. A method as claimed in claim 2, wherein the securing member comprises a finial impaling adjacent the two impaling members to receive a finial decoration at the centre of the chordal perimeter portion.

5. An assembly for the installation of sector-shaped curtains on correspondingly sector-shaped windows having a window casing with curved perimeter portion and a straight chordal perimeter portion between the ends of the curved perimeter portion by:

attaching to the window casing curved perimeter portion a length of one part of a two-part fastening material so as to extend from one end of the portion to the other;

providing a length of flexible curtain material;

gathering the flexible curtain material along one edge thereof until its gathered length is equal to that of the window curved perimeter portion;

attaching to the gathered curtain edge along its entire length a length of the other part of the two-part fastening material;

attaching the one part of the fastening material to the other part to attach the gathered curtain material to the window casing curved perimeter portion so as to extend from one end thereof to the other;

tensioning the gathered curtain material perpendicularly to the gathered edge and while so tensioned gathering its free edge and impaling it on an impaling member of a securing member disposed at least approximately at the middle of the length of the casing straight chordal perimeter portion;

the assembly comprising:

a length of the two part fastening material, one part of which is adapted to be fastened to the window casing curved perimeter portion and the other part of which is adapted to be fastened to the gathered edge of the flexible curtain material to permit its attachment to the first part fastened to the window casing curved perimeter portion;

a length of sheer gathering tape adapted to be fastened to the edge of the curtain that is to be gathered and therafter fastened to the window casing curved perimeter portion; and a securing member adapted to be fastened to the window casing straight chordal perimeter portion at about the centre thereof and having at least one impaling member protruding therefrom upon which the tensioned gathered curtain can be impaled to hold it under tension between itself and the respective other part of the two part fastening material.

6. An assembly as claimed in claim 5, wherein the securing member comprises two impaling members side-by-side, each member securing a respective half of the tensioned gathered curtain material.

7. An assembly as claimed in claim 5, wherein the securing member comprises a finial impaling member adjacent the impaling member to receive a finial decoration at the centre of the chordal perimeter portion.

8. An assembly as claimed in claim 6, wherein the securing member comprises a finial impaling member adjacent the two impaling members to receive a finial decoration at the centre of the chordal perimeter portion.

9. A securing member in combination with the installation of sector-shaped curtains on correspondingly sector-shaped windows each having a casing with a curved perimeter portion and a straight chordal perimeter portion between the ends of the curved perimeter portion by attaching to the window casing curved perimeter portion a length of one part of a two-part fastening material so as to extend from one end of the portion to the other;

providing a length of flexible curtain material;

gathering the flexible curtain material along one edge thereof until its gathered length is equal to that of the window curved perimeter portion;

attaching to the gathered curtain edge along its entire length a length of the other part of the two-part fastening material;

attaching the one part of the fastening material to the other part to attach the gathered curtain material to the window casing curved perimeter portion so as to extend from one end thereof to the other;

tensioning the gathered curtain material perpendicularly to the gathered edge and while so tensioned gathering its free edge and impaling it on an impaling member of a securing member disposed at least approximately at the middle of the length of the casing straight chordal perimeter portion, the securing member comprising:

a base member adapted to be fastened to the casing of the window chordal perimeter portion at about the centre thereof; and two transversely spaced impaling members which when the securing member is fastened to the window casing protrude side-by-side horizontally therefrom to receive respective halves of the tensioned gathered curtain.

10. A securing member as claimed in claim 9, wherein the base member also has protruding therefrom a finial impaling member disposed between the two first-mentioned impaling members and adapted to receive a centrally disposed finial decorative member.

11. An assembly as claimed in claim 5, including in combination therewith a length of flexible material for use in measurement of the required length of the gathered curtain material.

12. An assembly as claimed in claim 6, including in combination therewith a length of flexible material for use in measurement of the required length of the gathered curtain material.

13. A method as claimed in claim 1, wherein the length of flexible curtain material is of rectangular shape prior to its gathering along one edge thereof.

14. A method as claimed in claim 1, including the further steps of:

removing the impaled free edge of the length of flexible curtain material from the impaling member;

trimming surplus material from the free edge using as a guide for the trimming a plurality of holes made therein by the impaling member; and tensioning the trimmed material and re-impaling it on the impaling member.

15. A method for the installation of a sector shaped curtain over a sector-shaped member having a casing with a curved perimeter portion and a straight chordal perimeter portion between the ends of the curved perimeter portion, the method comprising the steps of:

attaching to the casing curved perimeter portion a length of one part of a two-part fastening material so as to extend from one end of the portion to the other;

providing a length of flexible curtain material;

gathering the flexible curtain material along one edge thereof until its gathered length is equal to that of the casing curved perimeter portion;

attaching to the gathered curtain edge along its entire length a length of the other part of the two-part fastening material;

attaching the one part of the fastening material to the other part to attach the gathered curtain material to the casing curved perimeter portion so as to extend from one end thereof to the other;

tensioning the gathered curtain material perpendicularly to the gathered edge and while so tensioned gathering its free edge and impaling it on an impaling member of a securing member disposed at least approximately at the middle of the length of the casing straight chordal perimeter portion.

16. A method as claimed in claim 15, including the further steps of:

removing the impaled free edge of the length of flexible curtain material from the impaling member;

trimming surplus material from the free edge using as a guide for the trimming a plurality of holes made therein by the impaling member; and tensioning the trimmed material and re-impaling it on the impaling member.

17. A method as claimed in claim 15, wherein the length of flexible curtain material is of rectangular shape prior to its gathering along one edge thereof.

18. An assembly for the installation of sector-shaped curtains over corresponding sector-shaped members having a casing with curved perimeter portion and a straight chordal perimeter portion between the ends of the curved perimeter portion by:

attaching to the casing curved perimeter portion a length of one part of a two-part fastening material so as to extend from one end of the portion to the other;

providing a length of flexible curtain material;

gathering the flexible curtain material along one edge thereof until its gathered length is equal to that of the casing curved perimeter portion;

attaching to the gathered curtain edge along its entire length a length of the other part of the two-part fastening material;

attaching the one part of the fastening material to the other part to attach the gathered curtain material to the casing curved perimeter portion so as to extend from one end thereof to the other;

tensioning the gathered curtain material perpendicularly to the gathered edge and while so tensioned gathering its free edge and impaling it on an impaling member of a securing member disposed at least approximately at the middle of the length of the casing straight chordal perimeter portion;

the assembly comprising:

a length of the two part fastening material, one part of which is adapted to be fastened to the casing curved perimeter portion and the other part of which is adapted to be fastened to the gathered edge of the flexible curtain material to permit its attachment to the first part fastened to the casing curved perimeter portion;

a length of sheer gathering tape adapted to be fastened to the edge of the curtain that is to be gathered and therafter fastened to the casing curved perimeter portion; and a securing member adapted to be fastened to the casing straight chordal perimeter portion at about the centre thereof and having at least one impaling member protruding therefrom upon which the tensioned gathered curtain can be impaled to hold it under tension between itself and the respective other part of the two part fastening material.

19. As assembly as claimed in claim 18, wherein the securing member comprises two impaling members side-by-side, each member securing a respective half of the tensioned gathered curtain material.

20. As assembly as claimed in claim 18, wherein the securing member comprises a finial impaling member adjacent the impaling member to receive a finial decoration at the centre of the chordal perimeter portion.

21. A securing member in combination with the installation of sector-shaped curtains over correspondingly sector-shaped members each having a casing with a curved perimeter portion and a straight chordal perimeter portion between the ends of the curved perimeter portion by attaching to the casing curved perimeter portion a length of one part of a two-part fastening material so as to extend from one end of the portion to the other;

providing a length of flexible curtain material;

gathering the flexible curtain material along one edge thereof until its gathered length is equal to that of the window curved perimeter portion;

attaching to the gathered curtain edge along its entire length a length of the other part of the two-part fastening material;

attaching the one part of the fastening material to the other part to attach the gathered curtain material to the casing curved perimeter portion so as to extend from one end thereof to the other;

tensioning the gathered curtain material perpendicularly to the gathered edge and while so tensioned gathering its free edge and impaling it on an impaling member of a securing member disposed at least approximately at the middle of the length of the casing straight chordal perimeter portion, the securing member comprising:

a base member adapted to be fastened to the casing of the chordal perimeter portion at about the centre thereof; and two transversely spaced impaling members which when the securing member is fastened to the casing protrude side-by-side horizontally therefrom to receive respective halves of the tensioned gathered curtain.

* * * * *